United States Patent [19]

Cheney et al.

[11] 4,249,740

[45] Feb. 10, 1981

[54] BOARD AND APPARATUS FOR SIMULTANEOUSLY PLAYING CHESS GAMES

[75] Inventors: Roland J. Cheney, 3050 Rue d'Orleans, San Diego, Calif. 92110; Calvin P. Owen, San Diego, Calif.

[73] Assignee: Roland J. Cheney, San Diego, Calif.

[21] Appl. No.: 59,550

[22] Filed: Jul. 23, 1979

[51] Int. Cl.[3] ..... A63F 3/02

[52] U.S. Cl. ..... 273/260; 273/288; 273/290

[58] Field of Search ..... 273/241, 260, 262, 288, 273/289, 261, 290

[56] References Cited

U.S. PATENT DOCUMENTS

| | | | |
|---|---|---|---|
| 1,141,909 | 6/1915 | D'Autremont | 273/260 |
| 1,554,094 | 9/1925 | Huff et al. | 273/242 |
| 1,877,154 | 9/1932 | Weaver | 273/241 |
| 2,896,950 | 7/1959 | Rosti et al. | 273/258 |
| 3,610,626 | 10/1971 | Nolte | 273/261 |
| 3,761,093 | 9/1973 | Migliore | 273/288 X |
| 3,937,471 | 2/1976 | Brennan | 273/241 |
| 4,114,891 | 9/1978 | Lawrimore | 273/290 X |

FOREIGN PATENT DOCUMENTS

| | | | |
|---|---|---|---|
| 201294 | 8/1923 | United Kingdom | 273/290 |
| 1239755 | 7/1971 | United Kingdom | 273/256 |

*Primary Examiner*—Richard C. Pinkham
*Assistant Examiner*—Scott L. Brown
*Attorney, Agent, or Firm*—Henri J. A. Charmasson

[57] ABSTRACT

A game set for simultaneously playing at least two interactional games on a single chessboard which comprises two or more subsets of pieces wherein each piece in each subset has a different size than the corresponding piece in the other subsets and is fractionally shaped in order to combine with at least one other piece from any other subset on a single square of the chessboard. The game in which a particular piece is currently operating is indicated by a color-coded ring insertable over a stub projecting from the top of said piece. The base of each piece is tierce-shaped with at least two adjacent sides defining vertical planes intersecting each other at 120° whereby at least two bases can be contiguously placed in a circular pattern on a single square of the chessboard.

5 Claims, 15 Drawing Figures

BOARD AND APPARATUS FOR SIMULTANEOUSLY PLAYING CHESS GAMES

BACKGROUND OF THE INVENTION

Prior art multi-dimensional chess games have been unsuccessful in devising a playing board which obviates the necessity of a three-tiered board arrangement. Although the instant invention is adaptable to the three-tiered configuration, a salient advantage over the prior art lies in the aggregation of three time frames upon one board and thus one plane, in which past, present and future relationships can be immediately and simultaneously perceived. Due to the complex nature of this archaic and historial game, and the necessity of a three-tiered structure in which the respective time zone pieces thereon may or may not be markedly distinguishable from one another, the problem is further exacerbated by the necessity to shift eye level to respective time frame plane, and thus conceptualize the superimposition of pieces which is necessary to interpret and respond appropriately to the idiosyncratic behavior of individual pieces. The present invention possesses an instant clarity to the players by means of a base configuration identifying origin of a particular piece and a projecting nib on the top of each piece which receives a time zone identifying marker to signal time frame location of a transient piece. This feature is unknown in the prior art and is believed to be a major advantage. A unique base configuration of the player pieces to accommodate propinquitious abutting on one square is also unknown in the prior art, and a definite and novel advantage can therefore be seen over prior art game sets.

There are a number of dimensional possibilities inherent in this versatile design, and an equal number of rules which may apply to time sequence relationships, as will be described.

SUMMARY OF THE INVENTION

The invention is a game set for the simultaneous playing of intragame and intergame chess interactional in the time frames of past, contemporary and future. As will be seen, a cohesive interactional balance exits between the planes which calls into play a playing piece's provenience and its physical presence in a time frame. Each time frame (past, contemporary and future), has a full complement of chess pieces in the quiescent state. The past game set is distinguished not only by its smaller and and more ornate structure, but also by three ridges forming the base thereof, as well as the classical distinguishing features which are familiar to those skilled in the art of chess playing. Past pieces are half as large as a conventional chess piece on a conventional chessboard and are either solid black or white. Future pieces have a one-ridge base and are the standard sized chess piece as would ordinarily be placed upon a standard chessboard. The future pieces are further distinguishable by an opacity, and as simple a design as possible yet still permitting identification of the piece's character. Contemporary pieces can be viewed in size and opacity continuum intermediary between past and future. The present design is closer akin to conventional chess pieces and bears a two-ridge base design. To even further clarify identity of pieces, i.e., rook, queen, knight, etc., each base is marked with a letter identification on its base structure whereby the lettering can be read from all angles. The letter identification on the pedestal of each piece is relevant to a function of the game, i.e., if a piece is eliminated in the past, its counterpart will be eliminated in the contemporary and future. For example, if the past queen's pawn is eliminated, then the corresponding contemporary and future queen's pawns will be eliminated. As there are several pawns that not only look alike but soon become indistinguishable as to which pawn they are, the lettering thus becomes a constant reminder.

The foregoing description has been somewhat detailed for purposes of plane origin. The playing position is designated by means of a projecting nib on the top of each playing piece which receives a color coded band identifying physical presence in a time plane, as follows: past, red; contemporary, yellow; and future, green.

To accommodate multiple occupancy of one square, the pieces are fractionally shaped to abut with at least one other piece. This configuration is in the form of a tierce-shaped base having at least two adjacent sides defining vertical planes intersecting each other at 120° and whereby three of said bases can be contiguously placed together on a single square.

The identification means described above will become apparent by the following rules which apply. Moves in the past affect past, contemporary and future. Moves in the contemporary affect contemporary and future but not the past. Moves in the future affect only the future. Therefore, if a white king's pawn is captured in the past, its counterparts in the contemporary and future will likewise be captured. At the opposite polarity, if the white king's pawn is captured in the future, there are no other counterparts eliminated. The dynamics of the game consist of either interaction upon one time plane or the execution of a time-move or time jump. A time move is the traversal of a time plane simultaneous with the natural horizontal move of the piece, the necessitates the placement of a time marker on the projecting nib referred to above. Time moves count as one move although they accomplish two functions, i.e., traversal of time and horizontal travel. Time jumps merely traverse time, do not accomplish horizontal travel, and only require the placement of a time marker on the piece's projecting nib. A retroactive function also applies in one rule variation which relates to origin. If a piece is temporarily in a time plane other than its origin, for example, a future piece in a past plane, and its counterpart is captured in the contemporary, only when it returns to the future will it be eliminated. A temporary limbo is thus created which enhances the variable potential of the game. A plethora of possibilities exist with this type of game set, however, a basic framework has been described to correlate the identifying marker system to the rules.

DETAILED DESCRIPTION OF THE DRAWINGS

DETAILED DESCRIPTION OF THE PREFERRED EMBODIMENT

Figure 1:
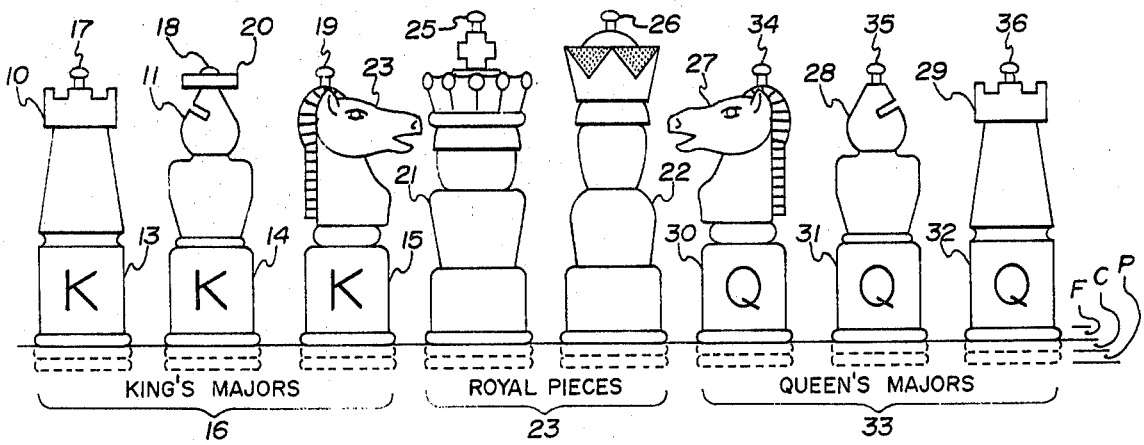
FIG. 1 is a side elevational view of the major and royal pieces.

The overall game set configuration is best seen in FIG. 1 wherein a rook 10, bishop 11 and knight 23 have letter markers "K" on pedestal portions 13, 14 and 15, respectively, which constitutes a king's majors 16 designation. Projecting nibs 17, 18 and 19 of king's majors 16 are provided to receive an elastomeric time plane ring 20 as shown mounted on nib 18 of bishop 11. Royal pieces 21, 22 are aggregated at 23 and have projecting nibs 25 and 26 thereon. Queen's major pieces comprise a knight 27, bishop 28 and rook 29 with letter markers "Q" on pedestal portions 30, 31 and 32, respectively, which constitute a queen's majors 33 designation. Queen's majors 33 also have projecting nibs 34, 35 and 36 thereon, which is true of all of the game pieces.

Figure 2:
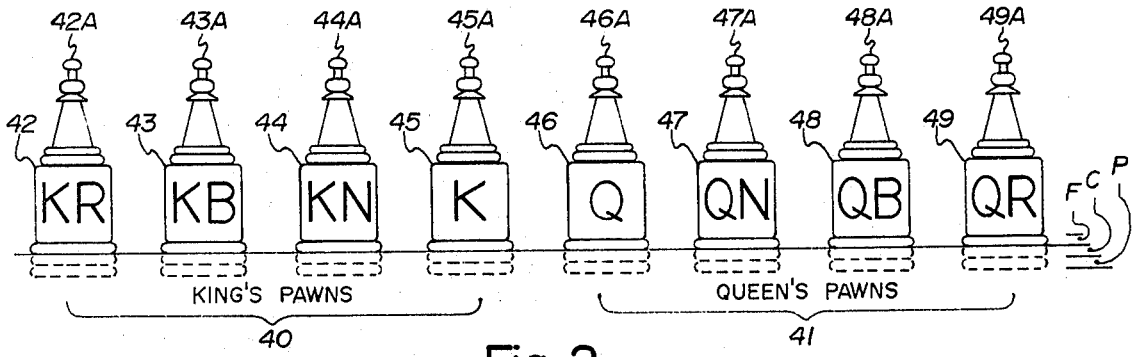
FIG. 2 is a front elevational view of all identified pawns.

FIG. 2 is a front elevational view of a full complement of pawns bisected through the center thereof to denote king's pawns 40 and queens pawns 41. More specifically, king's pawns have "K" letter designations on the pedestal portions as do queen's pawns have a "Q" designation on their pedestal portion. These pieces are further distinguishable by a second letter added to the pedestal and in the case of King's pawns 40 are designated king's rook pawn 42, king's bishop pawn 43, king's knight pawn 44 and with a double "K" on king's pawn 45. Queen's pawns 41 likewise have a comparable designation in queen's pawn 46, queen's knight pawn 47, queen's bishop pawn 48 and, finally, queen's rook pawn 49. The base portions also denote an F ridge representing future origin, a C ridge shown in phantom representing the present and the maximum of three ridges P representing the past. The classical pawn suprastructure portions 42–49 each have projecting nibs 42A through 49A for receiving an elastomeric time plane marker such as 20.

Figure 3:
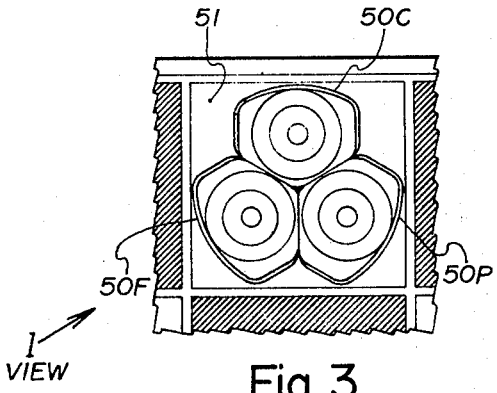
FIG. 3 is a top plan view of three fractionally abutting queens on a single square.
Figure 4:
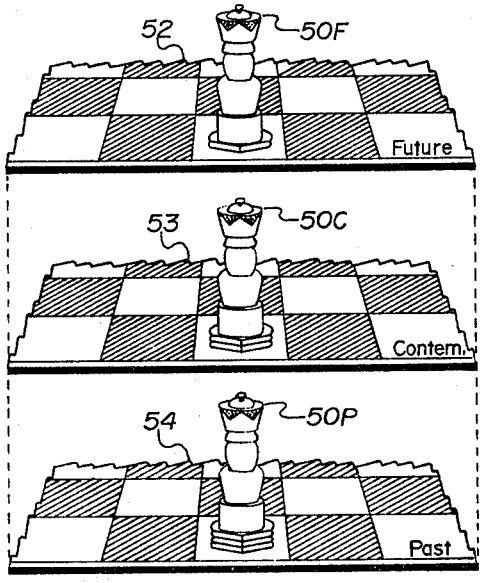
FIG. 4 is a three dimensional conceptualization equivalent to abutting queens of FIG. 3 representing three separate time planes and the appropriate queen on each time plane.

Queen's 50F, 50C and 50P are shown in top plan view in FIG. 3 where the fractional abutting relationship which allows for multiple occupancy of a single square 51 is illustrated. The three dimensional equivalent of the single plane occupancy of Queens 50F, 50C and 50P is shown in FIG. 4 where game boards 52–54 represent the time planes future, contemporary and past, respectively. This is an abstraction for purposes of illustrating the quiescent, game start position and the presence of the queens on each time plane level.

Figure 5:
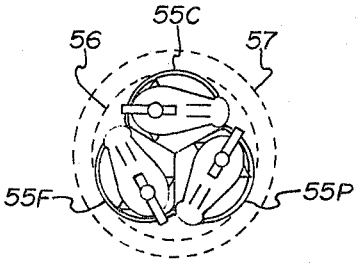
FIG. 5 is a top plan view of the fractionally abutting relationship between three knights.
Figure 6:
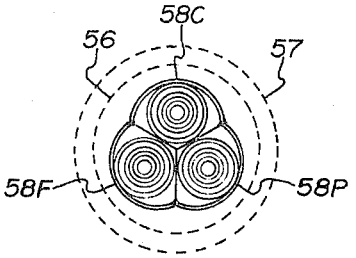
FIG. 6 is a top plan view of the fractional abutting arrangement between three pawns.

FIG. 5 shows yet another fractional abutting relationship of queen's knights 55F, 55C and 55P encircled in two phantom lines 56, 57 which represent major piece relative size and royal piece relative size, respectively, as compared to abutting pawns 58F, 58C and 58P of FIG. 6 which occupy an even smaller space relative to phantom lines 56 and 57 of FIG. 5.

Figure 7:
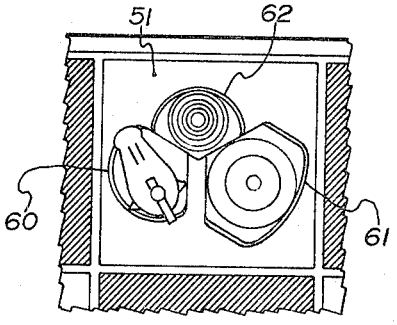
FIG. 7 is a top plan view of three pieces from separate time frames showing the fractional abutting relationship thereto.

After game start, the quiescent grouping of queens, kings, pawns, etc., upon one square will quickly shift to the hypothetical situation such as shown in FIG. 7. It can be seen that a fractional abutting relationship exits with a future knight 60, past queen 61 and contempory pawn 62. As shown in this figure, future knight 60 and past queen 61 are slightly separated to allow view of the smaller pawn 62 from at least two perspectives.

Figure 8:
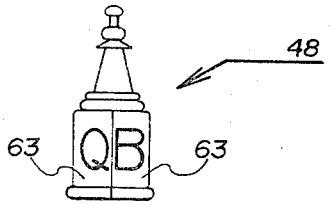
FIG. 8 is a rear elevational view of a pawn from FIG. 2 which illustrates an identifying pedestal configuration.

FIG. 8 illustrates the rear surfaces 63 of a future queen's bishop pawn 48 with dual vertical planes previously mentioned. This embodiment is included to illustrate the second pedestal designation "QB" which is typical positional information of all pawn pedestals. Major pieces 40 and 41 display dual "K" or dual "Q" respectively on corresponding rear surfaces.

Figure 9:
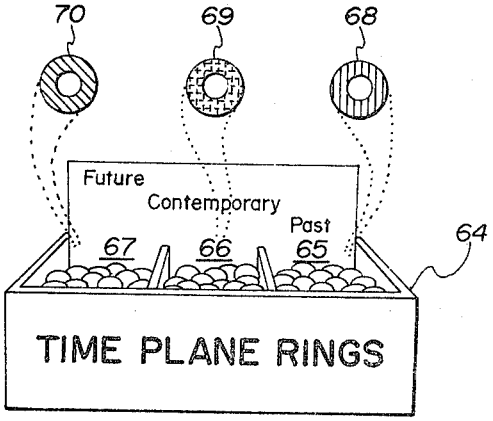
FIG. 9 is a perspective view of a time plane ring box and rings.

FIG. 9 represents a three-bined container 64 with past 65, contemporary 66 and future 67 open compartments containing red time plane rings 68 (past), yellow time plane rings 69 (contemporary), and green time plane rings 70 (future). The time plane rings are preferably composed of an elastomeric substance and the orifice in each time plane ring allows for temporary, yet snug placement on the aforementioned nibs 17–19, 25 and 26, 34–36 of FIG. 1 and pawn nibs 42A–49A of FIG. 2 to indicate physical presence in a time plane, irrespective of base-denoting origin. Rings can be installed and pieces moved with a single hand motion.

Figure 10:
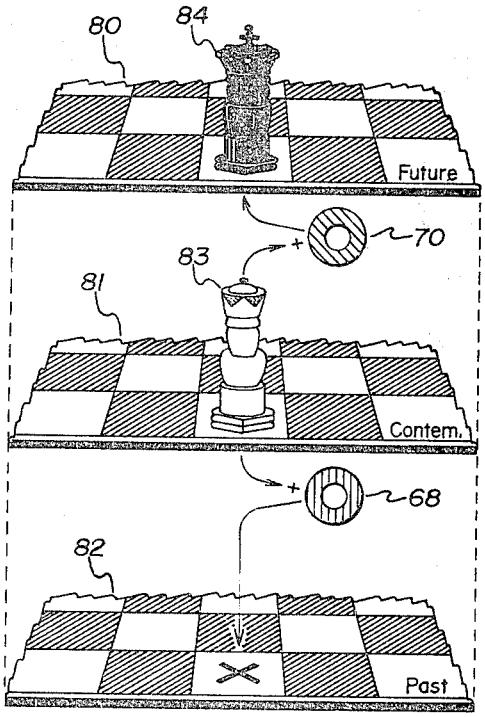
FIG. 10 is a rear perspective of the three-tiered conceptualization of the game board with time plane rings associated therewith.
Figure 11:
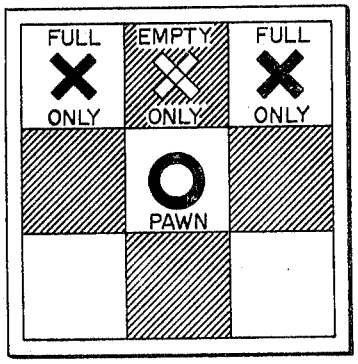
FIGS. 11 through 15 are top plan views which illustrate time plane and time jump move relationships of certain named pieces.

FIG. 10 is included for purposes of illustrating a time jump. Three gameboards 80, 81 and 82 representing future, contemporary and past, respectively, are shown. A black or white queen 83 occupies contemporary plane board 81. To accomplish a time jump merely involves placing the desired time plane ring 68, 69 or 70, on the playing piece nib. Thus, a future time plane ring 70 placed on queen 83 of gameboard 81 will accomplish one move and will put that piece into the future of gameboard 80. The move can be simply conceptualized by a vertical motion, either up or down, of the three-tiered abstraction of gameboards 80–82, of this figure. Since no two bodies can occupy the same space at the same time, a time jump by contemporary queen 83 upward to the future plane 80 by addition of time plane ring 70 would cause dual destruction of said queen and the future black king 84 located above it; whereas a downward time jump to the vacant past plane 82 could be accomplished by addition of time plane ring 68 without destruction of the queen 83 or any piece on past plane 82. Certain pieces may have the privilege of vertical time jumps to another dimension, as well as the natural horizontal moves which one would ordinarily observe in a chess game. The time move, therefore, can be conceptualized by a simultaneous vertical and horizontal motion, depending upon the limitations of the piece's behavior.

FIGS. 11 through 15 are devoted to the aforementioned move, which actually constitutes a dual move, as will be described.

Figure 12:
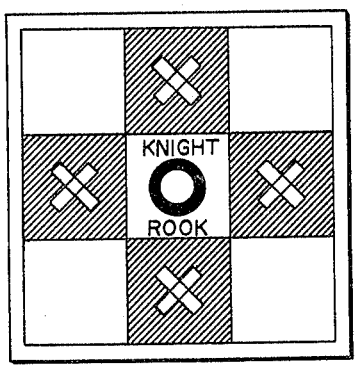
Figure 15:
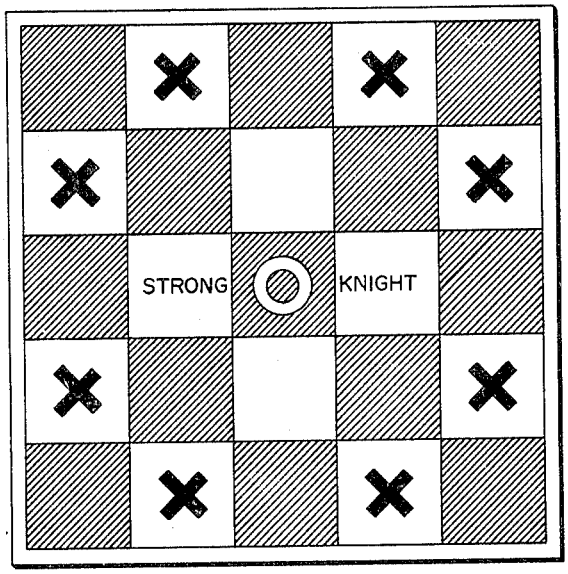
Figure 13:
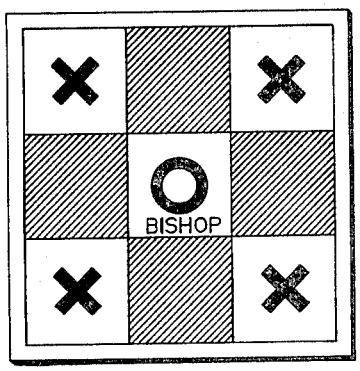
Figure 14:
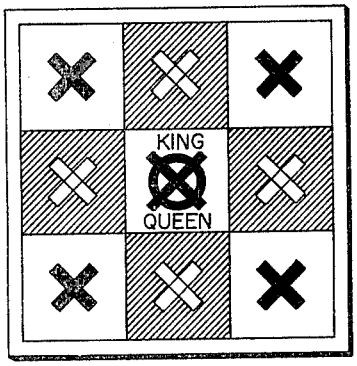

As previously discussed and illustrated in FIG. 10, time jumps merely consist of vertical motion from one time plane to the other as it can be visualized in space. These jumps are indicated by the affixing of a time plane ring to the piece operating out of its normal time plane ring. Time moves represent another characteristic of the potential game and are illustrated for the pawn in FIG. 11 where a pawn moving onto the contemporary time plane is indicated with the pawn's position, as indicated by 0 in either the past or the future and the squares indicated by X to which that pawn may move in the present. Squares diagonally adjacent and forward can be moved to only if that square is occupied, the square immediately forward only if that square is empty, or two on the first move. FIG. 12 illustrates the four squares which may be occupied in the present by a rook, or by a knight in an alternate optional game rule, time moving from the past or the future. FIG. 13 indicates the four squares which may be occupied by a bishop in the present or in the contemporary plane when the bishop moves from the past or the future. FIG. 14 indicates a similar pattern of nine squares which may be occupied in the present by a time move king or queen from the past or the future and FIG. 15 indicates the eight positions which may be occupied by a knight when moving to the contemporary plane from the past or the future planes.

What is claimed is:

1. A game set for simultaneously playing at least two interactional games of chess on a single chessboard wherein the pieces from each game have intragame and intergame moving abilities, and wherein the quality and potential of each piece in a current move are affected by its origin and its current location which comprises:

at least two subsets of pieces;

on each piece, means for indicating its game origin;

wherein each piece is fractionally shaped in order to combine with at least one other piece from any other subset; and comprises a tierce-shaped base having at least two adjacent sides defining vertical planes intersecting each other at 120° whereby three of said bases can be contiguously placed in a circular pattern on a single square of said board.

2. The game set claimed in claim 1 which further comprises on each piece means for indicating in which game said piece is currently operating.

3. The game set claimed in claim 1 or claim 2 wherein each piece in each subset has a different size than the corresponding piece in any one of the other subsets.

4. The game set claimed in claim 1 or claim 2 wherein each base is marked with an identification on each of its faces whereby the identification can be read from all angles.

5. A game set for simultaneously playing at least two interactional games of chess on a single chessboard wherein the pieces from each game have intragame and intergame moving abilities, and wherein the quality and potential of each piece in a current move are affected by its origin and its current location, which comprises:

at least two sets of pieces; and on each piece, means for indicating its game origin;

means for indicating in which game said piece is currently operating comprising:

a stub projecting from said piece for removably attaching an indicator, said indicator comprising at least two sets of color-coded rings insertable over said stub; and wherein each of said sets of pieces comprises three subsets of equal numbers of pieces, and a single, standard configuration chessboard.

* * * * *